US009583250B2

(12) United States Patent
Meyer et al.

(10) Patent No.: US 9,583,250 B2
(45) Date of Patent: Feb. 28, 2017

(54) MEMS TUNABLE INDUCTOR

(71) Applicant: U.S. Army Research Laboratory, Adelphi, MD (US)

(72) Inventors: Christopher D. Meyer, Bethesda, MD (US); Nathan S. Lazarus, Bethesda, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 572 days.

(21) Appl. No.: 14/016,284

(22) Filed: Sep. 3, 2013

(65) Prior Publication Data

US 2015/0302982 A1 Oct. 22, 2015

(51) Int. Cl.

| | |
|---|---|
| ***H01F 17/00*** | (2006.01) |
| ***H01F 27/02*** | (2006.01) |
| ***H01F 21/02*** | (2006.01) |
| ***H01F 21/10*** | (2006.01) |
| ***H01F 21/06*** | (2006.01) |

(52) U.S. Cl.

CPC ..... *H01F 21/06* (2013.01)

(58) Field of Classification Search

CPC ..... H01F 27/40; H01F 27/402; H01F 29/00; H01F 21/06; B23K 3/0315; E21B 47/122; G01V 3/34

USPC ..... 336/105, 90, 87, 145

See application file for complete search history.

(56) References Cited

U.S. PATENT DOCUMENTS 2,636,692 A * 4/1953 Picking ..... B65H 23/0208 226/19
2,738,425 A * 3/1956 Heath ..... G01R 33/1223 324/236
3,189,815 A * 6/1965 Barabutes ..... G01R 21/08 323/215
3,430,175 A * 2/1969 Matsuoka ..... H03J 3/16 334/12
3,518,595 A * 6/1970 Dawson ..... H01F 27/004 324/207.16
3,531,747 A 9/1970 Dunn et al.
3,603,864 A * 9/1971 Thaler ..... H01F 21/08 336/178

(Continued)

FOREIGN PATENT DOCUMENTS

FR EP 0048511 * 9/1981

OTHER PUBLICATIONS

M. M. Teymoori and J. M. Ahangarkolaei, "MEMS tunable inductors: a survey," Australian Journal of Basic and Applied Sciences, vol. 5, 2011, pp. 1868-1878.

*Primary Examiner* — Elvin G Enad
*Assistant Examiner* — Kazi Hossain
(74) *Attorney, Agent, or Firm* — Eric B. Compton

(57) ABSTRACT

Embodiments of the present invention provide a tunable inductor having a magnetic core which has an air gap. In order to vary the inductance of the inductor, the inductor includes a tuner that is moveable relative to the magnetic core in the vicinity of the air gap. An actuator is attached to the tuner which, upon actuation, moves the tuner relative to the magnetic core to thereby vary the spacing between the tuner and the core in the vicinity of the air gap. The variation of the spacing between the tuner and the magnetic core varies the effective air gap of the overall inductor in the desired fashion.

20 Claims, 1 Drawing Sheet

(56) References Cited

U.S. PATENT DOCUMENTS

| | | | | | |
|---|---|---|---|---|---|
| 3,649,912 | A * | 3/1972 | Nakamura | G01R 15/205 | 324/117 R |
| 4,980,794 | A * | 12/1990 | Engel | G01R 15/183 | 318/474 |
| 5,450,000 | A * | 9/1995 | Olsen | H02M 1/4225 | 323/222 |
| 5,461,308 | A * | 10/1995 | Jin | G01R 15/205 | 324/117 R |
| 5,872,489 | A | 2/1999 | Chang et al. | | |
| 5,999,077 | A * | 12/1999 | Hammond | H01F 29/10 | 336/134 |
| 6,184,755 | B1 | 2/2001 | Barber et al. | | |
| 6,429,639 | B1 * | 8/2002 | Pelly | G01R 15/202 | 324/117 H |
| 6,556,415 | B1 | 4/2003 | Lee et al. | | |
| 7,301,429 | B1 * | 11/2007 | Hall | E21B 47/01 | 324/339 |
| 7,486,002 | B2 | 2/2009 | Pulskamp | | |
| 2003/0156451 | A1 * | 8/2003 | Tamura | B81B 3/0051 | 365/179 |
| 2008/0136572 | A1 * | 6/2008 | Ayazi | H01F 17/0006 | 336/90 |
| 2009/0009280 | A1 * | 1/2009 | Ishihara | G01R 15/207 | 336/234 |
| 2011/0234351 | A1 * | 9/2011 | Kawarai | H01F 21/06 | 336/30 |
| 2012/0206226 | A1 * | 8/2012 | Lee | H01F 7/1646 | 335/229 |
| 2014/0077920 | A1 * | 3/2014 | Andersson | H01F 17/043 | 336/233 |

* cited by examiner

MEMS TUNABLE INDUCTOR

GOVERNMENT INTEREST

The invention described herein may be manufactured, used, and licensed by or for the United States Government.

BACKGROUND OF THE INVENTION

I. Field of the Invention

The present invention relates to inductors and, more particularly, to a tunable inductor.

II. Description of Relevant Art

Tunable inductors, and in particular MEMS tunable inductors, form an important component of both power and communication systems. Tunable inductors are used as a frequency control element in communication systems, allowing communication networks to be used in different frequency bands. Variable inductors can be used to vary the resonant frequency of inductor-capacitor (LC) tanks used in voltage controlled oscillators and other RF circuits and to control bandwidth and cut-off frequency of tunable filters. In power systems, tunable inductors can change the impedance of matching networks during operation, allowing load matching for more efficient power delivery.

There have been previously known MEMS tunable inductors which utilize actuators, such as electrostatic actuators, to vary the inductance of the inductor. A survey of the forms of MEMS tunable inductors commonly used is given in M. M. Teymoori and J. M. Ahangarkolaei, "MEMS tunable inductors: a survey," Australian Journal of Basic and Applied Sciences, vol. 5, 2011, pp. 1868-1878, herein incorporated by reference. To briefly summarize, the largest tuning ratios are typically achieved using switch-based techniques, where the configuration of discrete inductors is changed, by for instance adding additional inductors in series by closing MEMS switches. Although effective, this technique only allows only a handful of specific inductance to be obtained; continuous tuning is impossible without an infinite number of segments and switches. A number of approaches have been demonstrated for creating continuous tuning, but typically with much smaller tuning ratios. These methods include changing the permeability of a magnetic material in the core by an additional bias field, or physically changing the position of coils relative to each other to change the coupling between them. A magnetic core can also be selectively inserted or retracted into a coil to change the inductance. As discussed in the survey paper, the best continuous tuning techniques available generally only can obtain a tuning ratio of 3 or 4.

The inductance of an inductor is dependent upon the strength and scale of the magnetic field that is created when electrical current passes through one or more inductors wound around the core. Consequently, inductors with magnetic cores of high permeability, such as iron-containing alloys or ceramics, are oftentimes used to increase the magnetic field response of the inductor. For a magnetic core inductor where the magnetic flux is contained within the core, the inductance L is given by $$L = \frac{N^2 \mu_{r,core} \mu_0 A_{core}}{l_{core}},$$

where N is the number of turns, $l_{core}$ is the length of the loop, $A_{core}$ is the core cross sectional area, $\mu_{r,core}$ is the relative permeability of the core and $\mu_0$ is the permeability of free space.

As shown, when the magnetic core fully links all of the inductor coils through a closed loop, the inductance is directly proportional to the permeability of the core. For example, common core materials such as iron-containing alloys or ceramics have permeabilities in the hundreds or thousands while some exotic materials, such as metglas, exhibit permeability in the millions. However, for high currents, most magnetic materials begin to saturate thus reaching a maximum magnetic flux density above which the inductor behaves nonlinearly.

In order to prevent saturation of the magnetic core, many magnetic cores include an air gap. With an air gap, the inductance of the coil is dominated by the air gap when $\mu_{r,core}$ is large; the inductance is approximately given by $$L = \frac{N^2}{\frac{l_{gap}}{\mu_0 A_{gap}} + \frac{l_{core}}{\mu_{r,core} \mu_0 A_{core}}} \approx \frac{N^2 \mu_0 A_{gap}}{l_{gap}},$$

where $A_{gap}$ is the area of the gap and $l_{gap}$ is the length of the gap. Consequently, by providing an air gap, the linearity of the inductor is improved but at a great loss in the overall inductance of the inductor.

SUMMARY OF THE PRESENT INVENTION

The present invention provides a tunable inductor which overcomes all of the above mentioned disadvantages of the previously known devices.

In brief, the tunable inductor of the present invention comprises a magnetic core which includes an air gap. In order to vary the inductance of the inductor, the inductor includes a tuner that is moveable relative to the magnetic core in the vicinity of the air gap. An actuator is attached to the tuner which, upon actuation, moves the tuner relative to the magnetic core to thereby vary the spacing between the tuner and the magnetic core in the vicinity of the air gap. The variation of the spacing between the tuner and the magnetic core varies the effective air gap of the overall inductor in the desired fashion.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
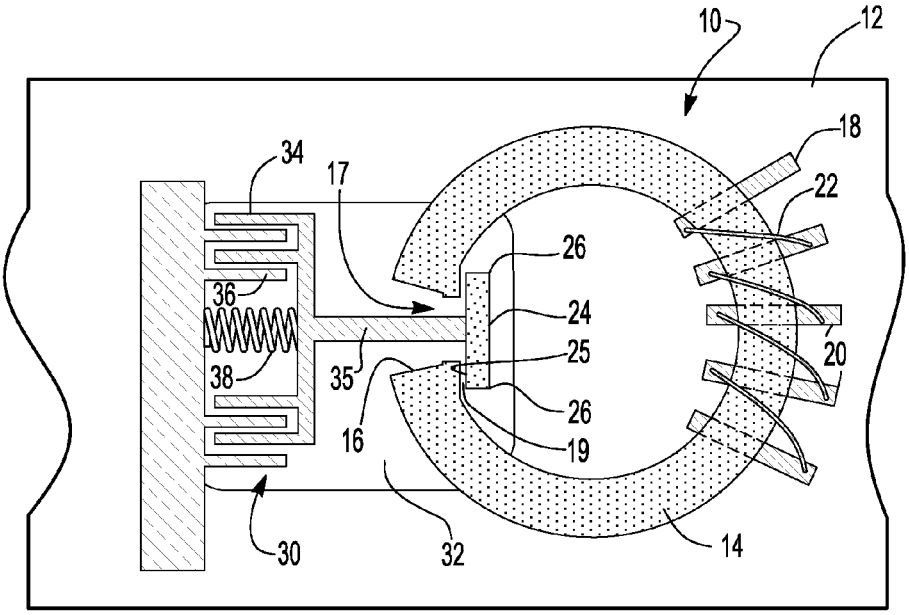
FIG. 1 is a plan view of a preferred embodiment of the MEMS tunable inductor of the present invention.

With reference first to FIG. 1, one embodiment of a tunable inductor 10 in accordance with the present invention is shown. In this embodiment, the tunable inductor 10 is designed to be a microelectromechanical system (MEMS)

device having components generally of the micrometer size. However, the size of the tunable inductor should not be construed as limiting, and in other embodiments, the tunable inductor 10 need not be a MEMS and/or can have larger size components.

The MEMS tunable inductor 10 may be formed on substrate 12. As shown, the substrate 12 may be generally planar. In addition, it will be appreciated that the MEMS tunable inductor 10 illustrated in FIG. 1 is illustrated in a greatly magnified form (for ease of explanation).

The MEMS tunable inductor 10 includes a magnetic core 14. Here, the magnetic core 14 is generally C-shaped having two ends 16 defining an air gap 17. The air gap 17 is essentially a void or separation between the ends 16 of the C-shaped magnetic core 14. The term "air gap" as used herein is believed to be consistent with the use of that term in the art. It does not require air or any other medium to be present in the void. For example, the inductor might be present in a vacuum and still be considered to have an "air gap."

The magnetic core 14 can be constructed of any conventional ferromagnetic material, such as permalloy, and can be formed on the substrate 12 utilizing any conventional manufacturing technique, such as depositing the ferromagnetic material onto the substrate 12. Furthermore, although the magnetic core 14 is illustrated in FIG. 1 as being substantially circular in shape, other shapes may be used without deviation from the spirit or scope of the invention.

A coil 18 is also formed on the substrate 12 so that the coil 18 is wound around or otherwise surrounds at least a portion of the magnetic core 14. Any conventional manufacturing technique may be used to construct the coil 18. For example, electrically conductive strips 20 may be first deposited on the substrate 12 prior to the magnetic core 14 so that the magnetic core 14 is deposited over a central portion of each strip 20. Electrically conductive wire bonds 22 may then be used to connect the ends of adjacent strips together to complete the coil. Upon excitation of the coil 18, electrical current flows through the coil 18 creating a magnetic field in the magnetic core 14.

Still referring to FIG. 1, a tuner 24 is formed on the substrate 12. For instance, the tuner 24 may be constructed of a ferromagnetic material, such as permalloy. The tuner 24 is preferably elongated in shape having two ends 26. As shown, the width of the tuner 24 may be larger than the width of said air gap 17 such that each end 26 of the tuner 24 overlies a corresponding portion of the core 14 on opposite sides of the air gap 17.

In order to vary the inductance of the MEMS tunable inductor 10, an actuator 30 together with the tuner 24 are mounted within a recessed area 32 on the substrate 12. The actuator 30 is mechanically connected to the tuner 24 so that a movable portion 34 of the actuator 30 and tuner 24 move in unison with each other. An elongated member 35 of the moveable portion 34 of the actuator 20 is displaceable through the air gap 17. The actuator 30 is configured to move the tuner 24 in a direction substantially perpendicular to the plane defined by the ends 16 of the magnetic core 14 and the air gap 17.

The actuator 30 may be an electrostatic actuator, for example, having an immovable actuator part 36. Although, in other embodiments, the actuator 30 may be a piezoelectric actuator or other type of actuator. In response to a control signal, such as an electrical signal, the actuator parts 34 and 36 variably separate (from their position in FIG. 1) to move the tuner 24 relative to the core 14 (to their position in FIG. 2). The actuator also may include at least one spring 38 to bias the position of the tuner 24 in a known position. The spring(s) 38 may be positioned at other locations than what is illustrated in the figures.

Figure 2:
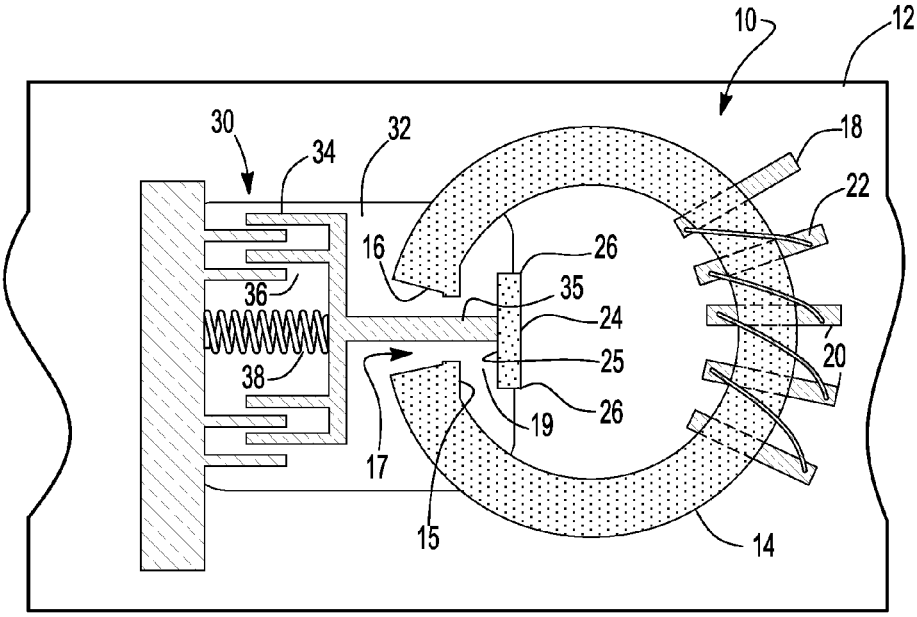
FIG. 2 is a view similar to FIG. 1, but illustrating a variation in the air gap of the magnetic core to vary the inductance of the inductor.

With reference now to FIGS. 1 and 2, in operation upon application of a control signal to the actuator 30, the actuator 30 moves the tuner 24 between a first position, illustrated in FIG. 1, and a second position, illustrated in FIG. 2, and/or intermediate positions there between. In doing so, the spacing 19 between the tuner 24 and the magnetic core 14 in the vicinity of the air gap 17 is varied to thereby vary the overall inductance of the inductor 10.

The spacing 19 is a result of the physical separation between the surface 25 of the tuner 24 and the surface 15 of the magnetic core 14 in the vicinity of the air gap 17. In some instances, the spacing 19 may be defined as the perpendicular distance between a surface 15 of the magnetic core 14 and a surface 25 of the tuner 24 in the vicinity of the air gap 17, for instance. Although, it should be appreciated that the spacing 19 might be defined by other geometric conventions relative to those parts.

In the first position, the spacing 19 between the tuner 24 and the magnetic core 14 in the vicinity of the air gap 17 may be at a minimum. Moreover, in some embodiments, in the first position, the surface 25 of the tuner 24, near its ends 26, physically contacts or abuts the surface 15 of the magnetic core 14, near its ends 16, thus closing the spacing 19 between the tuner 24 and the magnetic core 14 in the vicinity of the air gap 17. As a result, the tuner 24 effectively bridges and closes the air gap 17 of the magnetic core 14. This greatly increases the overall inductance of the inductor 10.

When, in the second position, the surface 25 of the tuner 24, near its ends 26, is physically separated from the surface 15 of the magnetic core 14, near its ends 16. As a result, the spacing 19 between the tuner 24 and the magnetic core 14 in the vicinity of the air gap 17 may be at a maximum.

Moreover, the actuator 30 may enable continuous variable tuning capability. For example, the actuator 30 may be configured to move the tuner 24 relative to the magnetic core 14 to any intermediate position between the first position (see FIG. 1) and second position (see FIG. 2) for selectively varying the inductance of the inductor 10. Depending on the type and/or operation of actuator provided, the actuator 30 may provide the ability to smoothly tune without requiring discrete step tuning.

Embodiments of the present invention can be used to provide controlled tuning of an inductor by controlling the air gap 17 in the magnetic core 14. The width of the air gap 17 between ends 16 of the magnetic core 14 may be on the order of a few millimeters, for instance. Yet the spacing 19 between the surface 25 of the tuner 24 and the surface 15 of the magnetic core 14 can be made much smaller than the width of the air gap 17. And the distance that the tuner 24 needs to move, e.g., between the first position and second position, to bridge and close the air gap 17 can be made much less.

The tunable inductor embodiments described herein may be used for load matching to improve power efficiency in power systems and converters, for instance. In addition to power applications, the tunable inductors may be used for radio frequency (RF) and other communication systems such as radios and cellular telephones. The tunable inductors can allow transceivers to shift between frequency bands. Other applications for the tunable inductors include their use as tunable filters, voltage controlled oscillators (VCOs), matching networks, and possibly as an alternative to tunable capacitors in an electrical resonator circuit (e.g., a LC tank). The tunable inductors could also be used as a sensor device where inductance corresponds to a measured deflection of the magnetic core. If tuning ratios are large, they might also be considered for tunable meta-materials and tunable discrete transmission lines.

The tunable inductor embodiments advantageously allow for a tuning ratio an order of magnitude greater than that of conventional tuning inductors. For example, the embodiments of the present invention may provide a tuning ratio in the hundreds whereas conventional inductors have a tuning ratio of only about 2-10. And since one tunable inductor can provide a greater tuning ratio, it can eliminate or reduce the need for multiple inductors within a given system. By contrast, for conventional inductors, larger tuning ratios (of app. 10) tend to be based on using MEMS switches to switch the total number of inductors placed in series, which are very area intensive and have high resistances due to the switch contact resistances. Accordingly, smaller, lighter, faster and more energy efficient (lower loss) inductors may be realized by the present invention.

From the foregoing, it can be seen that the present invention provides a tunable inductor in which the inductance of the inductor may be varied over a wide range of inductance by varying the effective air gap of an air gap magnetic core. The ability to vary the inductance of the inductor 10 over a wide range of inductance enables the inductor 10 to be used in a wide range of applications, including power and communication applications.

Having described my invention, many modifications thereto will become apparent to those skilled in the art to which it pertains without deviation from the spirit of the invention as defined by the scope of the appended claims.

NUMBER KEY

10 MEMS tunable inductor
12 substrate
14 magnetic core
15 surface
16 ends
17 air gap
18 coil
19 spacing
20 strips
22 wire bonds
24 tuner
25 surface
26 ends
30 actuator
32 recessed area
34 movable part
35 elongated member
36 stationary part
38 spring

We claim:

1. A tunable inductor comprising:

a magnetic core having an air gap, a tuner moveable in a radial direction within an interior space of the magnetic core in the vicinity of the air gap, and an actuator attached to said tuner which, upon actuation, moves the tuner within the interior space of said magnetic core to thereby vary the radial spacing between said tuner and said magnetic core in the vicinity of the air gap, wherein said actuator comprises a spring to bias said actuator, and wherein said tuner is movable between a first position and a second position relative to said magnetic core, wherein in said first position, the radial spacing between said tuner and said magnetic core in the vicinity of the air gap is at a minimum, and wherein in said second position, the radial spacing between said tuner and said magnetic core in the vicinity of the air gap is at a maximum.

2. The tunable inductor as defined in claim 1 wherein said actuator comprises an electrostatic or piezoelectric actuator.

3. The tunable inductor as defined in claim 1 wherein said magnetic core is constructed of permalloy.

4. The tunable inductor as defined in claim 1 wherein said tuner is constructed of a ferromagnetic material.

5. The tunable inductor as defined in claim 1 wherein in said first position, one or more portions of said tuner abut against an inner surface of said core facing the interior space thus closing the radial spacing between said tuner and said magnetic core in the vicinity of the air gap.

6. The tunable inductor as defined in claim 1 wherein the width of the air gap is larger than the radial spacing between said magnetic core and said tuner in the vicinity of the air gap when said tuner is in said second position.

7. The tunable inductor as defined in claim 1 wherein said actuator is configured to modulate the radial spacing between said tuner and said magnetic core in the vicinity of the air gap in response to a control signal.

8. The tunable inductor as defined in claim 1 wherein said magnetic core is generally C-shaped having two ends and said air gap comprises a void between the two ends of said magnetic core.

9. The tunable inductor as defined in claim 1 wherein the width of said tuner is larger than the width of said air gap.

10. The tunable inductor as defined in claim 1 wherein said tuner is an elongated element having two ends.

11. The tunable inductor as defined in claim 10 wherein each end of said tuner overlaps a surface of said magnetic core on both sides of said air gap.

12. The tunable inductor as defined in claim 8 wherein said actuator is configured to move said tuner in a direction substantially perpendicular to a plane defined by said ends of said magnetic core and said air gap.

13. The tunable inductor as defined in claim 4 wherein the tuner is constructed of permalloy.

14. The tunable inductor as defined in claim 1 further comprising a coil surrounding at least a portion of said magnetic core.

15. The tunable inductor as defined in claim 1 wherein a portion of the said actuator is displaceable through said air gap.

16. The tunable inductor as defined in claim 1 wherein the inductor is a MEMS device.

17. An electronic device comprising the tunable inductor as defined in claim 1.

18. A tunable inductor comprising:

a magnetic core generally surrounding an interior space and having ends defining an air gap, a ferromagnetic tuner moveable within the interior space, and an actuator coupled to the tuner which, upon actuation, moves the tuner to vary the perpendicular spacing in the vicinity of the air gap between a surface of the tuner facing the actuator and an inner surface of magnetic core facing the interior space, wherein said actuator comprises a spring to bias said actuator, wherein said tuner is movable between a first position and a second position relative to said magnetic core, wherein in said first position, the perpendicular spacing between said tuner and said magnetic core in the vicinity of the air gap is at a minimum, and wherein in said second position, the perpendicular spacing between said tuner and said magnetic core in the vicinity of the air gap is at a maximum, and wherein said perpendicular spacing changes the inductance of the inductor.

19. The tunable inductor as defined in claim 1, wherein the spring comprises a coil spring.

20. The tunable inductor as defined in claim 1, wherein the spring biases the tuner in the first position or the second position.

* * * * *